United States Patent [19]

Dwyer

[11] Patent Number: 4,569,642

[45] Date of Patent: Feb. 11, 1986

[54] SLURRY PUMP

[76] Inventor: Anthony F. Dwyer, 10 Windsor Rd., Finchley, London N3, England

[21] Appl. No.: 460,681

[22] Filed: Jan. 24, 1983

[30] Foreign Application Priority Data

Jan. 22, 1982 [GB] United Kingdom ..... 8201838

[51] Int. Cl.[4] ..... F04B 15/02

[52] U.S. Cl. ..... 417/516; 417/519; 417/532; 417/900

[58] Field of Search ..... 417/516, 517, 519, 900, 417/518, 532; 366/143, 349

[56] References Cited

U.S. PATENT DOCUMENTS

| | | | |
|---|---|---|---|
| 1,868,615 | 7/1932 | Radford . | |
| 3,663,129 | 5/1972 | Antosh | 417/900 |
| 3,832,097 | 8/1974 | Schlect | 417/516 |
| 4,178,142 | 12/1979 | Schwing | 417/519 |

FOREIGN PATENT DOCUMENTS

| | | | |
|---|---|---|---|
| 0046902 | 3/1982 | European Pat. Off. | 417/900 |
| 1285319 | 12/1968 | Fed. Rep. of Germany . | |
| 2104191 | 8/1972 | Fed. Rep. of Germany . | |
| 2447054 | 4/1975 | Fed. Rep. of Germany | 417/519 |
| 2362670 | 6/1975 | Fed. Rep. of Germany . | |
| 2931814 | 2/1981 | Fed. Rep. of Germany | 417/516 |
| 1362 | of 1910 | United Kingdom . | |
| 29404 | of 1911 | United Kingdom . | |
| 1447696 | 8/1976 | United Kingdom . | |
| 2039603 | 8/1980 | United Kingdom . | |
| 1585794 | 3/1981 | United Kingdom | 417/517 |

*Primary Examiner*—Cornelius J. Husar
*Assistant Examiner*—Peter M. Cuomo
*Attorney, Agent, or Firm*—Flynn, Thiel, Boutell & Tanis

[57] ABSTRACT

A slurry pump has a hopper containing slurry. A pumping cylinder containing a piston communicates with the hopper through the hopper wall. A delivery tube is swung into and out of register with the cylinder. Slurry is drawn into the cylinder by the piston and out through the delivery tube. The pump is controlled by a lever which has a central neutral position and two operating positions.

Dangerous moving parts are covered by a guard mounted on hinges. An arm on the guard engages a slide which has a channel. If the guard is moved from its closed position, the arm slides the slide so that the control lever enters the channel and moves to its neutral position. The external moving parts include releasable clamping means for sealing the junction of the delivery tube and the cylinder while slurry is being transferred from the cylinder to the tube.

14 Claims, 9 Drawing Figures

SLURRY PUMP

BACKGROUND OF THE INVENTION

The present invention relates to slurry pumps which comprise a hopper, a pumping cylinder communicating at one end with an opening in the hopper, a piston reciprocatable within the cylinder, drive means for reciprocating the piston, a cranked delivery tube have a pivotally mounted portion and drive means for swinging the tube about the axis of its pivotally mounted portion to bring a swinging end of the tube into and out of register with the pumping cylinder.

The moving parts of slurry pumps with swinging delivery tubes present considerable dangers to workmen. Accordingly it is an object of the present invention to provide a safety mechanism whereby the dangers presented by the moving parts are minimised.

A slurry pump having the safety mechanism provided by the invention has a guard having a closed position in which the guard prevents access to a part of the slurry pump, and an open position in which the guard permits access. The pump is characterised by a cam surface which is moved by movement of the guard from its closed position to cause the control member to adopt its neutral position if it is not in its neutral position and thereafter prevents the control member moving from its neutral position until the guard has been returned to its closed position.

BRIEF DESCRIPTION OF THE DRAWINGS

Embodiments of the, invention will now be described by way of example reference to the accompanying drawings in which.

DETAILED DESCRIPTION

Figure 1:
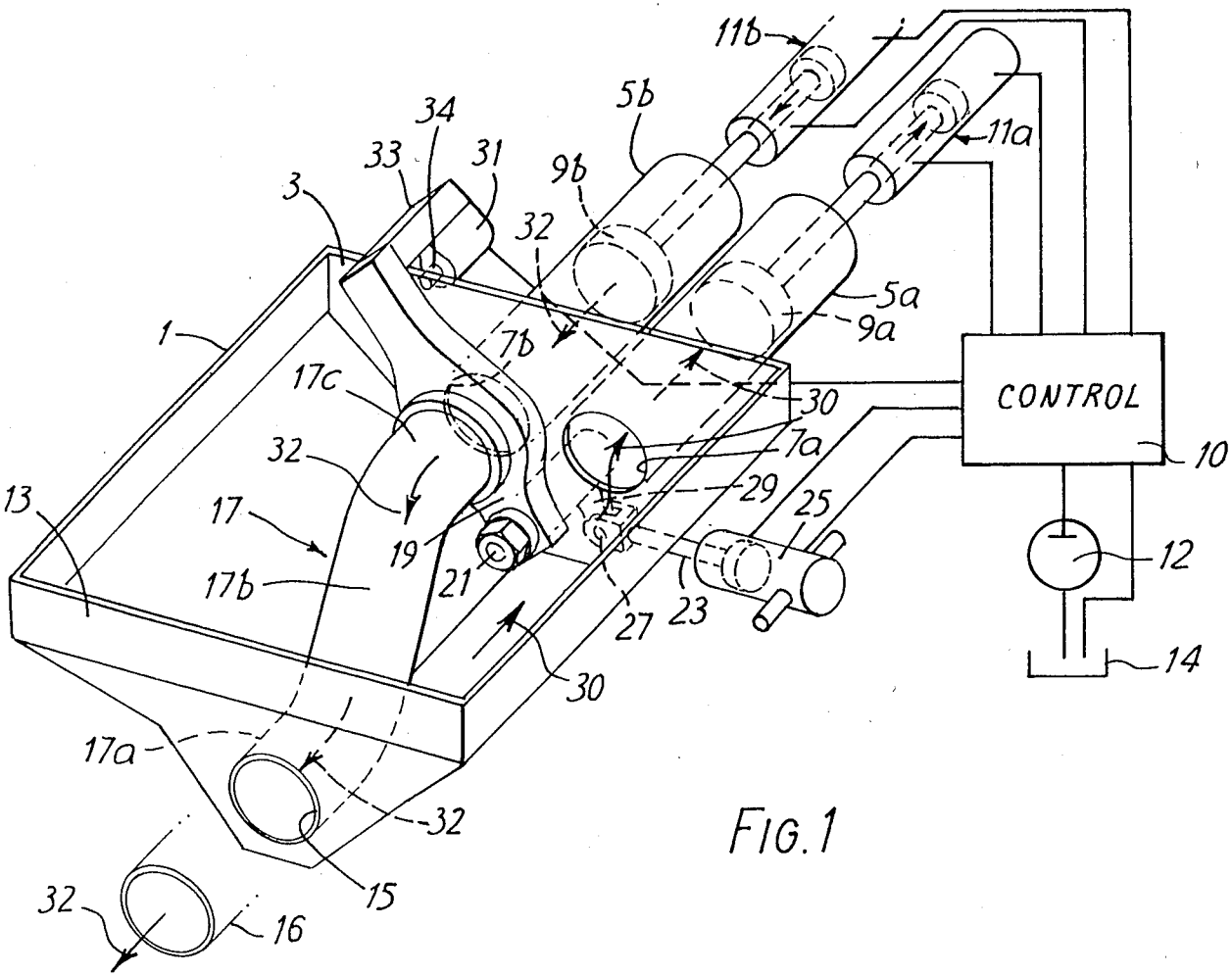
FIG. 1 is a perspective view of a concrete pump.
Figure 3:
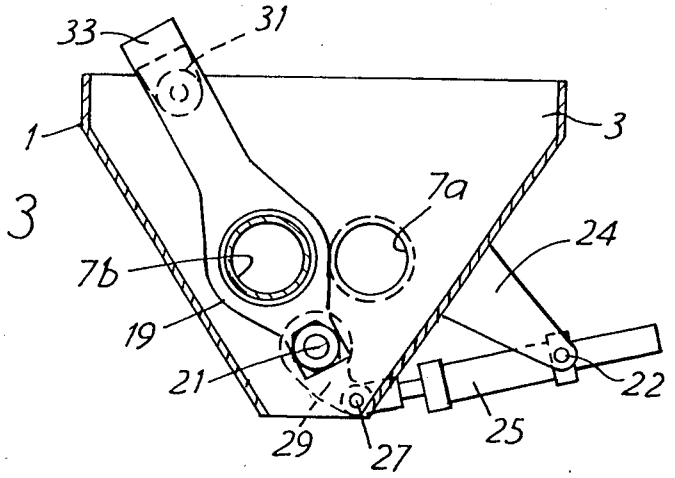
FIG. 3 is a cross section of the pump along the line III—III in FIG. 2.
Figure 2:
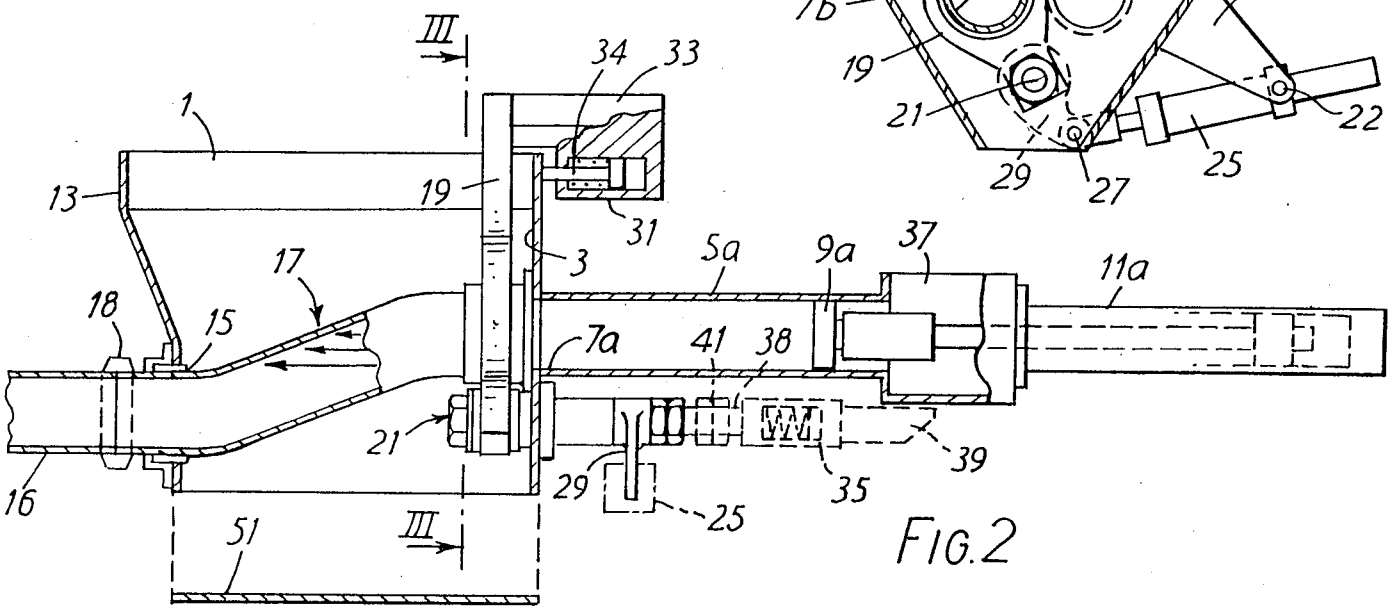
FIG. 2 is an elevational view of the pump shown in FIG. 1, and shows a possible modification in broken lines.

The concrete pump shown in FIGS. 1 to 3 has a hopper 1. Two pump cylinders 5*a*, 5*b* communicate at one end with the interior of the hopper 1 through holes 7*a*, 7*b* in a wall 3 of the hopper.

Two reciprocable pistons 9*a*, 9*b* are contained one in each pump cylinder 5*a*, 5*b* and are driven in opposite phase by hydraulic rams 11*a*, 11*b* which are supplied with pressurised fluid by a control system 10, shown schematically in FIG. 1. A motor-driven hydraulic pump 12 provides pressurised hydraulic fluid to the control system 10 from a reservoir 14.

The end wall 13 of the hopper, opposite to the wall 3, has an outlet port 15, below the level of the holes 7*a*, 7*b*. A cranked delivery tube 17 has a straight portion 17*a* which is journal mounted in the outlet port 15. The journal-mounted portion 17*a* is connected to a pipe line 16 by means of a swivel coupling 18 (FIG. 2). The cranked portion 17*b* of the delivery tube 17 extends across the hopper 1, to the end wall 3. The delivery tube 17 terminates at the end wall 3, to form a swinging end 17*c* which is pivotally mounted on the hopper wall 3 by means of a supporting arm 19 and pivotal mounting 21.

The axes of the pivotal mounting 21 and the journal mounting in the outlet port 15 are coincident, and so the delivery tube 17 is angularly displaceable about this axis. The swinging end 17*c* of the delivery tube 17 can be brought into and out of register with the holes 7*a*, 7*b*, alternately, by the piston rod 23 of a hydraulic ram 25 supplied by the control 10. The ram drives the supporting member 19 through the mounting 21 by means of a clevis connection 27 to an arm 29. The ram 25 is attached to the hopper 1 by means of a pivotal mounting 22 on an arm 24, see FIG. 2, extending from one side wall of the hopper 1.

Releasable clamping means are provided which when actuated clamp the swinging end of the delivery tube 17 to the hopper wall 3, around one or other of the holes 7*a*, 7*b*.

The clamping means may be provided in a variety of ways. FIG. 1 shows an extension of the supporting member 19 which circumvents and is clamped to the delivery tube and extends out of the top of the hopper 1. A rigid cross-member 33 projects from the top of the supporting member 19 above the wall 3 of the hopper 1. A hydraulic ram 31 is attached to the cross member 33, and has a piston rod 34 which projects towards the wall 3. When the ram 31 is actuated by the control system 10, the piston rod 34 is driven against the outer surface of the wall 3, and a force is transmitted through the cross-member 33 and the supporting member 19 to hold the swinging end of the delivery tube 17 in sealing contact with the inner surface of the wall 3 around the hole 7*a* or 7*b*. When the control system 10 releases the actuating pressure, a spring returns the piston rod to its initial position.

An alternative clamping means is shown in broken lines in FIG. 2 and does not require the extension of the supporting member 19, or the integers attached thereto. A hydraulic ram 35 is mounted on the case 37 of the pump cylinders 5*a*, 5*b*, by means of a bracket 39. The piston rod 38 of the ram 35 is attached to the shaft of the pivotal mounting 21 by means of a swivel connection 41. When the ram 35 is actuated by the control system 10, the piston rod 38 is drawn away from the hopper, and pulls on the arm 19, through the mounting 21. The swinging end 17*c* of the delivery tube 11 is therefore pulled into sealing contact with the wall 3 around the respective hole 7*a*, 7*b*.

Figure 4:
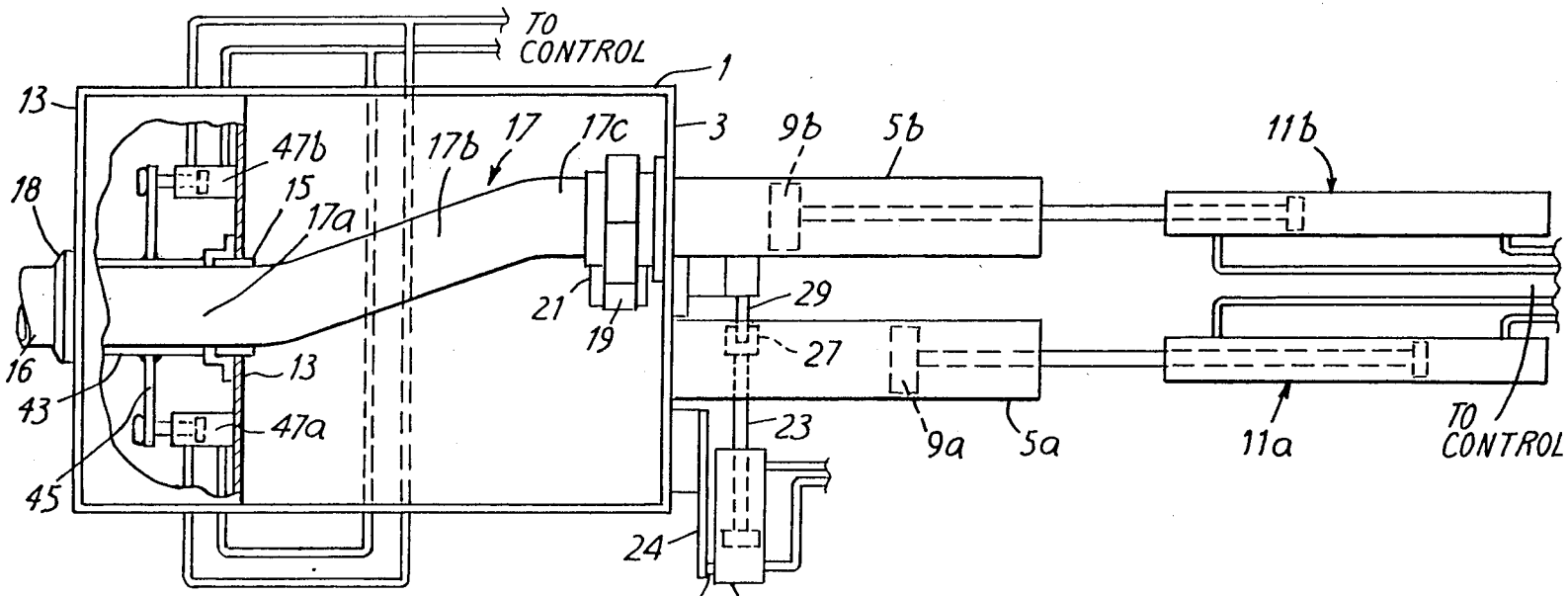
FIG. 4 is a plan view of a second concrete pump with portions cut away.

In the modified pump shown in FIG. 4 (where parts corresponding to those of the pump shown in FIGS. 1 to 3 are indicated by the same reference numeral) a sleeve 43 is placed around the straight portion 17*a* of the delivery tube 17. The sleeve 43 lies in a hole in the plate 45 and is welded to the plate. The plate 45 extends in a plane perpendicular to the axis of the sleeve 43. Two hydraulic rams 47*a*, 47*b* are attached to the hopper wall 13, one to either side of the output port 15. The line of action of the rams 47*a*, 47*b* is upwardly inclined and passes through the wall 3 at the height of the centre of the holes 7*a*, 7*b*. When the rams 47*a*, 47*b* are actuated by the control system 10 they draw the plate 45 towards the hopper 1. The sleeve 43 pushes on the delivery tube 17 which moves in the journal bearing at the exit port 15 to clamp the swinging end of the delivery tube 17 to the wall 3.

The clamping means hold the swinging end 17*c* of the delivery tube 17 against the wall 3, counteracting the separation force on the tube due to the pumping pressure which tends to separate the tube 17 from the wall 3. Such movement could cause leakage of some of the liquid phase of the concrete from the tube, with the risk of causing the residual aggregate to block the tube and an incorrect mixture being delivered.

To comply with safety requirements, guards must be placed around the external moving parts. The top of the hopper 1 is preferably covered with a grill through which slurry may be poured but which prevents workmen reaching into the hopper. The pump control lever could be arranged so that it passes through the guards and grill and be so shaped that it prevents the guards and grill from being removed except when the lever is in its "OFF" position. Alternatively as will be described in more detail, the pump control lever is arranged so that when the guards or grill are removed the lever is returned to its "OFF" position.

In operation, when pumping concrete, a region below the level of the holes 7*a*, 7*b*, should be filled with sand. It is found that this sand remains in position and becomes covered by a thin skin of set cement or concrete. This prevents concrete from remaining static in the bottom of the hopper and thereby setting.

The direction of movement of concrete during pumping is indicated in FIG. 1 by arrows 30, 32. During the first half of a pumping cycle, concrete is drawn into the pump cylinder 5*a*from the hopper 1, in the direction shown by the arrows 30. Meanwhile the pump cylinder 5*b* expels concrete through the hole 7*b* into the delivery tube 17, which is clamped to the wall 3 by the clamping means (31, 35 or 47). The concrete then passes along the delivery tube, through the outlet port 15 and into the pipeline 16, in the direction shown by arrows 32. When the cylinder 5*b* is empty, the clamping means are released and the delivery tube 17 is swung by the ram 25 into register with the cylinder 5*a*. The clamping means are then re-engaged and the second half of the cycle commences during which the piston 9*a* pumps concrete through the delivery tube 17 to the pipeline 16. When the pump cylinder 5*a* is empty, the clamping means are released, the ram 25 swings the delivery tube back to its initial position, in register with cylinder 5*b*, and the cycle recommences.

After pumping, the thin concrete skin formed over the same may be broken with a rod and washed out with the sand and any concrete remaining, through the bottom of the hopper, which is formed with an opening 50 which is closed by a removable plate 51 (FIG. 2).

The rams 3, 31, 35, 47*a* and 47*b* which have been described as hydraulic could also be powered by one of the following means: pneumatics, electromagnetic devices, jackscrew threads, rack and pinion devices, ball screws or electromechanical actuators.

The pump may be used in reverse, (by reversing the connections to the ram 25) to draw slurry into the pump through the port 15, and thence into the hopper 1. Similarly reverse pumping of water can be used to clean the pump after use.

The safety mechanism whereby the pump control lever is returned to its "OFF" position when the guards and grill are removed will now be described with reference to FIGS. 5 to 8.

Figure 5:
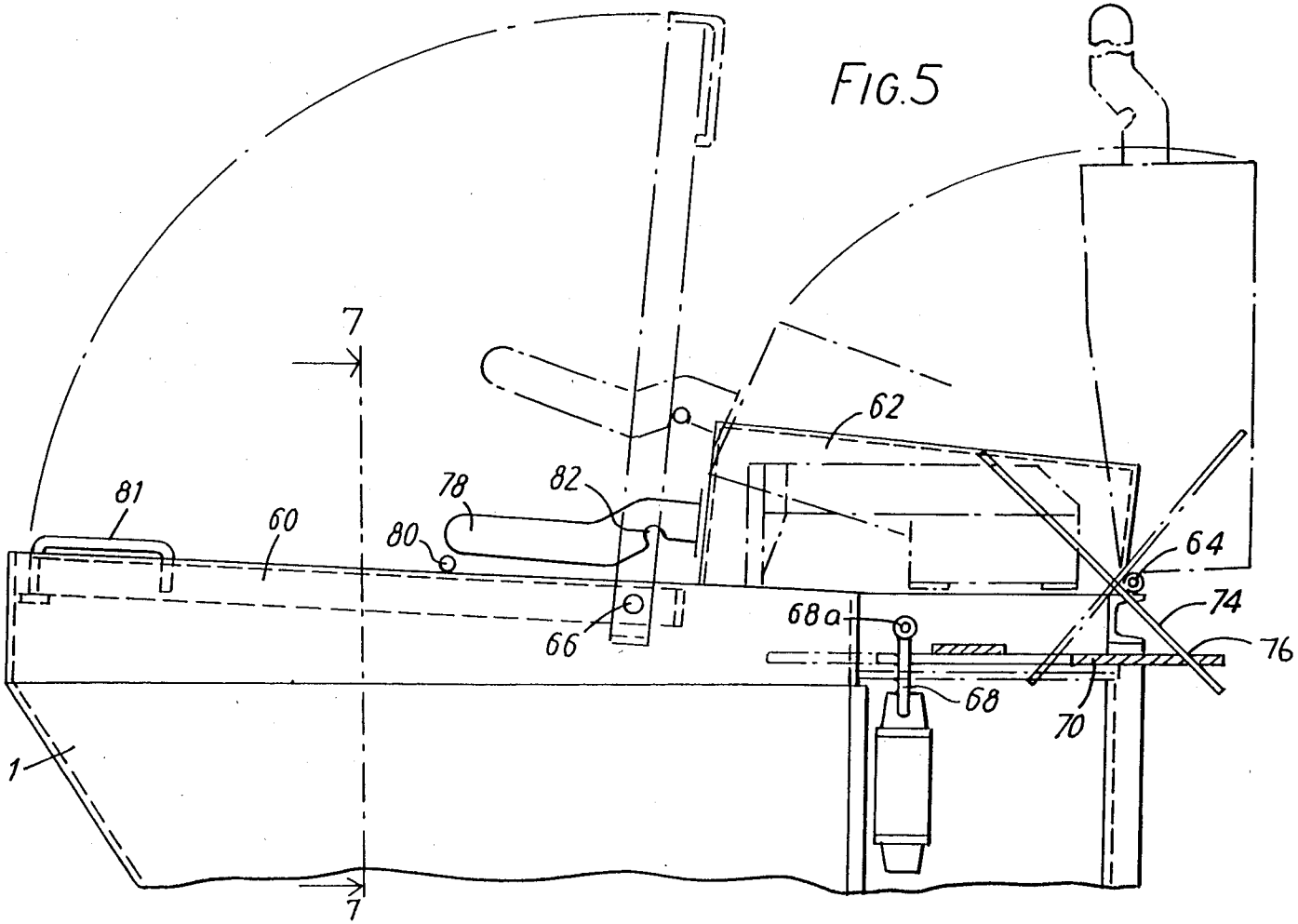
FIG. 5 is a partial elevational view of the pump of FIGS. 1 to 4, adapted to incorporate the safety mechanism of invention.

Referring now to FIG. 5, the hopper 1 is covered by a grill 60, shown by broken lines. A guard 62 covers the moving parts of the pump external to the hopper 1, during operation of the pump. The guard 62 is pivotally mounted on the pump by a hinge 64, so that it may be raised for access to the moving parts, for instance for maintenance. The guard can be raised through approximately 90° to a position shown in chain-dotted lines in FIG. 5. The grill 60 is pivotally mounted at 68 so that it can be raised through approximately 90° to the position indicated by chain-dotted lines in FIG. 6. The raised grill allows access to the hopper for the purpose of clearing the hopper, for instance.

Figure 7:
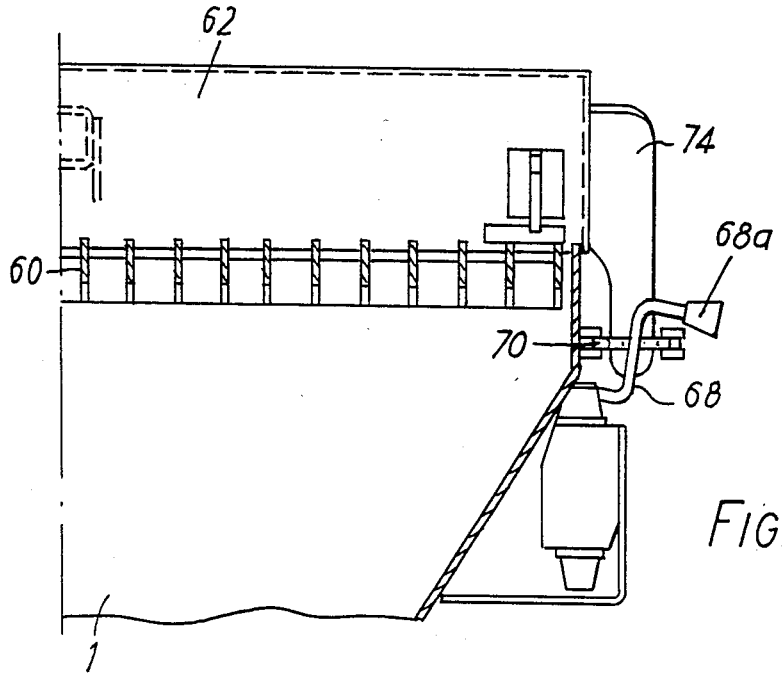
FIG. 7 is a partial sectional view of the pump of FIGS. 5 along the lines 7—7 in FIG. 5.
Figure 8A:
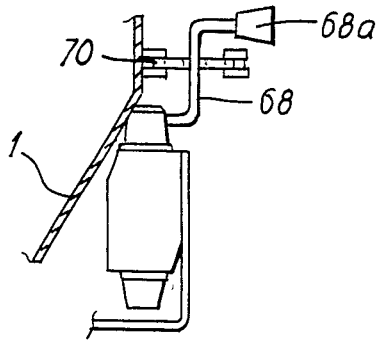
FIGS. 8*a*, 8*b* shows the control member from the same viewpoint as FIG. 7, is two alternative positions to that of FIG. 7.
Figure 8B:
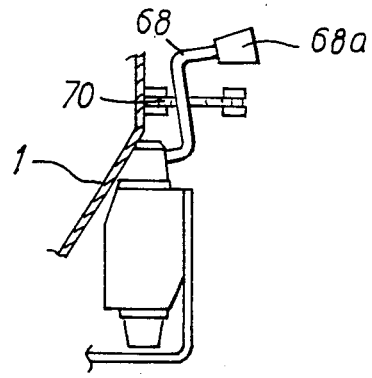

The slurry pump is controlled by a manually operable control lever 68, which has at one end a handle 68*a*, and which has three detent positions to select forward pumping, reverse pumping and neutral or "OFF", respectively. FIGS. 7, 8*a* and 8*b* show the control lever positioned to select forward pumping, neutral and reverse pumping respectively.

Figure 6:
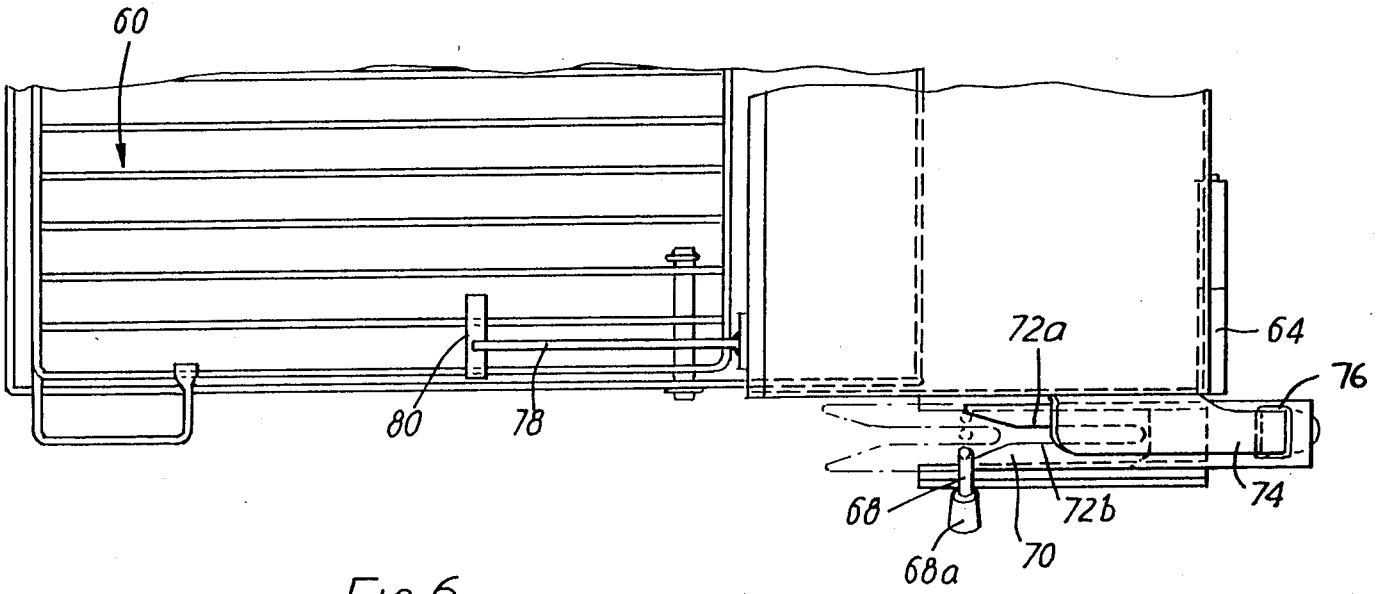
FIG. 6 is a partial plan view of the pump of FIG. 5.

A forked strip 70 is mounted to be horizontally slidable between first and second extreme positions shown in solid and chain-dotted lines respectively in FIGS. 5 and 6. The forked strip 70 defines a channel 72 having an inner position in which the channel sides are parallel with each other and with the line along which the forked strip is movable, and an outer portion in which the channel sides (72*a*, 72*b*) widen towards the channel mouth. A lever 74 is mounted on the guard 62 and, therefore, pivots with the guard 62 about the axis of the hinges 64. The lever 74 extends through an aperture 76 in the fork 70. As the guard 62 is raised from the position shown in solid lines in FIG. 5 to the position shown in chain-dotted lines in FIG. 5, the lever 74 rotates about the axis of the hinges 64 and bears on the forked strip 70 to slide the forked strip from the first to the second positons shown in FIG. 6.

The inner section of the channel 72 has position and width so as only to allow the forked strip to slide past the control lever 68, when the control lever is in its neutral position. If the lever is not in its neutral position when the guard is opened, the sides of the channel 72 act as cam surfaces on the lever to cause the lever to revert to its neutral position. If the lever is in its neutral position before the guard is opened, the lever remains in that position. The inner, parallel-sided portion of the channel prevents the lever being moved from its neutral position until the forked strip has been moved back to its first position, shown in solid lines, in response to the guard being closed, when the pump is again safe to be used. The pump is therefore, automatically switched off if the guard is raised.

The pump is also automatically switched off if the grill is raised, as will now be described. A coupling arm 78 is attached to the guard 62 and, when the guard 62 and grill 60 are shut, extends above the grill 60. The coupling arm 78 is cranked and has a lower surface which is nearer to the grill 60 at the end of the arm remote from the guard 62 than at the end adjacent its point of attachment to the guard.

A bar 80 is attached to the upper surface of the grill 60 and is generally parallel to the axis of the pivotal mounting 66 of the grill 60. When the grill 60 is raised, by means of a handle 81 integral with the grill, the bar 80 engages and runs along the underside of the coupling arm 78, thereby also causing the guard 62 to be raised.

The grill 60 cannot be raised without the guard 62 being raised and, consequently, the grill 60 cannot be raised without the control lever being set to its neutral position, and the pump thereby switched off.

The lever surface of the coupling arm 78 defines a detent recess 82 which can engage the bar 80 to lock the grill 60 in its open position (shown in chain-dotted lines in FIG. 5).

It will be seen from the above description that the pump cannot be operated unless both the grill and the guard are closed. The safety mechanism cannot be overridden or fail to operate.

While the grill and the guard have been described as separate integers, it will be apparent that the grill could be integral with the guard. The coupling between the grill and the guard would not then be required.

I claim:

1. A slurry pump comprising a hopper, a pumping cylinder communicating at one end with an opening in the hopper, a piston reciprocatable within the cylinder, drive means for reciprocating the piston, a cranked delivery tube having a pivotally mounted portion, drive means for swinging the tube about the axis of its pivotally mounted portion to bring a swinging end of the tube into and out of register with the pumping cylinder, a control member for controlling the drive means and having a neutral position, in which the drive means are inoperative and a second position in which the drive means are operable, and a guard having a closed position in which the guard prevents access to a part of the slurry pump, and an open position in which the guard permits access, characterised by a cam surface which is moved by movement of the guard from its closed position to cause the control member to adopt its neutral position if it is not in its neutral position and to retain the control member in its neutral position until the guard has been returned to its closed position.

2. A slurry pump according to claim 1, characterised by the control member having positions selecting forward and reverse pumping on opposite sides of the neutral position, and two cam surfaces which are moved by movement of the guard from its closed position to return the control member to its neutral position if it is not in its neutral position, and to retain the control member in its neutral position until the guard has been returned to its closed position.

3. A pump according to claim 1, characterised in that the cam surface is formed by a slide member, and the guard carries an arm which engages the slide member to cause it to slide in response to movement of the guard.

4. A pump according to claim 1, characterised by releasable clamping means engageable to clamp the swinging end of the tube to the periphery of the opening during transfer of slurry through the opening.

5. A pump according to claim 4, characterised in that it comprises two pump cylinders and the tube drive means are arranged to bring the tube end alternately into register with each cylinder and the clamp means is arranged to perform a clamping action when the delivery tube is in register with either pump cylinder and slurry is being pumped into the delivery tube from one of the pump cylinders.

6. A pump according to claim 4, characterised in that the swinging end of the delivery tube is supported by a supporting member pivotally mounted on the hopper, the axs of the pivotal mounting being coincident with the axis of the pivotal mounting of the pivotally mounted portion of the swinging tube.

7. A pump according to claim 4, characterised in that the clamping means is attached to an arm attached to the delivery tube at or near the second end of the said tube and extending out of the top of the hopper, and the clamping means acts between an outer wall surface of the hopper and tne arm.

8. A pump according to claim 6, characterised in that the clamping means exerts a force on the said supporting member and along the pivot axis of the supporting member.

9. A pump according to claim 4, characterised in that the delivery tube passes through a second opening in a wall of the hopper, and the clamping means acts on the delivery tube outside the hopper.

10. A slurry pump comprising a hopper, a pumping cylinder communicating at one end with an opening in the hopper, a piston reciproctable within the cylinder, drive means for reciprocating the piston, a cranked delivery tube having a pivotally mounted portion and drive means for swinging the tube about the axis of its pivotally mounted portion to bring a swinging end of the tube into and out of register with the pumping cylinder, releasable clamping means engageable to clamp the swinging end of the tube to the periphery of the opening during the transfer of slurry through the opening, a guard having a closed position in which it prevents access to a part of the slurry pump and an open position in which it permits access, a control member for controlling the drive means, and a cam member which is moved by movement of the guard from its closed position to cause the control member to adopt a neutral position if it is not in its neutral position and to retain the control member in its neutral position until the guard has been returned to its closed position.

11. A pump according to claim 10, characterised by the control member having positions selecting forward and reverse pumping on opposite sides of the neutral position, and two cam surfaces which are moved by movement of the guard from its closed position to return the control member to its neutral position if it is not in its neutral position, and to retain the control member in its neutral position until the guard has been returned to its closed position.

12. A pump according to claim 10, characterised in that the cam member is formed by a slide member, and the guard carries an arm which engages the slide member to cause it to slide in response to movement of the guard.

13. A slurry pump comprising a hopper, said hopper having walls including two opposed walls, a first opening in a first of said opposed walls, an aperture in the second of said opposed walls, a cranked delivery tube having a first end portion mounted in the aperture for swinging movement about its axis, swinging means for swinging said tube to move a second end of said delivery tube transversely into and out of register with the first opening, a first pumping cylinder communicating with said hopper through said first opening, a first piston reciprocatable within said pumping cylinder, first drive menas for reciprocating said first piston, releasable clamping means operable to clamp said second end of said tube to the periphery of said first opening during transfer of slurry by said first piston from said first cylinder into said tube through said first opening, said aperture being at a lower level than said first opening and said tube sloping generally downwardly from said second end to said first end portion when said second end is in register with said first opening, a second opening in the first of said opposed walls, said second opening being at a higher level than said aperture, a second pumping cylinder communicating with the hopper through said second opening, a second piston reciprocatable in said second cylinder, second drive means for said second piston, said swinging means being operable to swing said second end into register with said openings alternately, said clamping means being operable to clamp said second end to the periphery of either of said openings during transfer of slurry through that opening, an arm supporting said second end, a shaft extending through the first of said opposed walls, said arm being pivotally mounted by means of said shaft to swing about the swinging axis of said first end portion, and said clamping means comprising force-exerting means outside said hopper and operable to exert a clamping force on said shaft along said axis.

14. A slurry pump comprising a hopper, said hopper having walls including two opposed walls, a first opening in a first of said opposed walls, an aperture in the second of said opposed walls, a cranked delivery tube having a first end portion mounted in the aperture for swinging movement about its axis, swinging means for swinging said tube to move a second end of said delivery tube transversely into and out of register with the first opening, a first pumping cylinder communicating with said hopper through said first opening, a first piston reciprocable within said pumping cylinder, first drive means for reciprocating said first piston, releasable clamping means operable to clamp said second end of said tube to the periphery of said first opening during transfer of slurry by said first piston from said first cylinder into said tube through said first opening, said aperture being at a lower level than said first opening and said tube sloping generally downwardly from said second end to said first end portion when said second end is in register with said first opening, a second opening in the first of said opposed walls, said second opening being at a higher level than said aperture, a second pumping cylinder communicating with the hopper through said second opening, a second piston reciprocatable in said second cylinder, second drive means for said second piston, said swinging means being operable to swing said second end into register with said openings alternately, said clamping means being operable to clamp said second end to the periphery of either of said openings during transfer of slurry through that opening, said clamping means comprising an arm mounted on said second end and extending upwardly out of said hopper, and force-exerting means operable to exert a force between said arm and an outside surface of a wall of said hopper.

* * * * *